United States Patent [19]

Kanegae et al.

[11] 4,086,773

[45] May 2, 1978

[54] VAPOR TEMPERATURE/PRESSURE CONTROL SYSTEM FOR AN AUTOMOTIVE VAPOR-POWERED ENGINE

[75] Inventors: Hidetoshi Kanegae; Akio Hosaka, both of Yokohama, Japan

[73] Assignee: Nissan Motor Company, Limited, Yokohama, Japan

[21] Appl. No.: 739,021

[22] Filed: Nov. 4, 1976

[30] Foreign Application Priority Data

Nov. 4, 1975 Japan ..... 50-150332

[51] Int. Cl.[2] ..... F01K 13/02

[52] U.S. Cl. ..... 60/664; 60/667; 60/668; 122/448 R; 122/3

[58] Field of Search ..... 60/660, 664, 665, 667, 60/668; 180/67; 290/40 R; 122/3, 448; 236/14

[56] References Cited

U.S. PATENT DOCUMENTS

| | | | |
|---|---|---|---|
| 3,417,737 | 12/1968 | Shinskey et al. | 122/448 R |
| 3,545,207 | 12/1970 | Barber et al. | 60/664 X |
| 3,894,396 | 7/1975 | Durrant | 60/665 |
| 3,906,731 | 9/1975 | Carlson | 60/665 |

*Primary Examiner*—Allen M. Ostrager
*Attorney, Agent, or Firm*—Bacon & Thomas

[57] ABSTRACT

The temperature and pressure of the vapor generated in a vapor generating unit are so controlled that a fuel supply valve is opened for fuel delivery when the temperature or pressure drops below a predetermined lower limit and is closed when the temperature or pressure exceeds a predetermined upper limit, provided that a vehicle operator manipulable throttle valve is substantially in a fixed position. As the throttle valve is abruptly moved, an acceleration or deceleration signal opens or closes the fuel supply valve independently of the actual vapor temperature and pressure.

12 Claims, 5 Drawing Figures

VAPOR TEMPERATURE/PRESSURE CONTROL SYSTEM FOR AN AUTOMOTIVE VAPOR-POWERED ENGINE

This invention relates generally to steam or vapor powered engine for motor vehicles and in particular to vapor temperature/pressure control system of a vapor generating means for such engines.

Rankine cycle engines sometimes simply called "steam engine", as different from gasoline powered internal combustion engines, are under consideration for use with motor vehicles from the viewpoint of low air pollution.

As in usual steam power plants, an automotive vapor powered engine is associated with a vapor generating unit or boiler which produces steam or vapor by heating water or other liquid by combustion of liquid, solid or gaseous fuel. Since the volume of vapor to be delivered to the engine greatly depends on the vapor temperature and pressure, it is required to keep the vapor temperature and pressure as constant as possible for stable operation of the engine. The vapor temperature and pressure is efficiently controlled by metering the volume of fuel to be delivered to a furnace of the vapor generating unit.

However, it is actually difficult to stably control the vapor temperature or pressure since it is considerably varied with change in the load applied to the engine. This is particularly significant in automotive vapor engines in which engine load is greatly and rapidly changed by angular displacement of the throttle valve or accelerator which is arbitrarily operable by a vehicle operator.

Therefore, the main object of this invention is to provide a system to maintain the temperature and pressure of vapor or steam to be delivered to an automotive vapor powered engine within a predetermined range of variation.

Another object of this invention is to provide a system to control the temperature and pressure of the vapor or steam to be supplied to the engine of the aforementioned type by controlling the fuel supply to a vapor generating unit of the engine usually in accordance with desired reference values of the vapor temperature or pressure, and in quick response to the engine load if the latter is abruptly changed.

Other objects, features and advantages of this invention will be readily understood from the following detailed explanation of preferred embodiments, reference being made to the accompanying drawings, in which.

Figure 1:
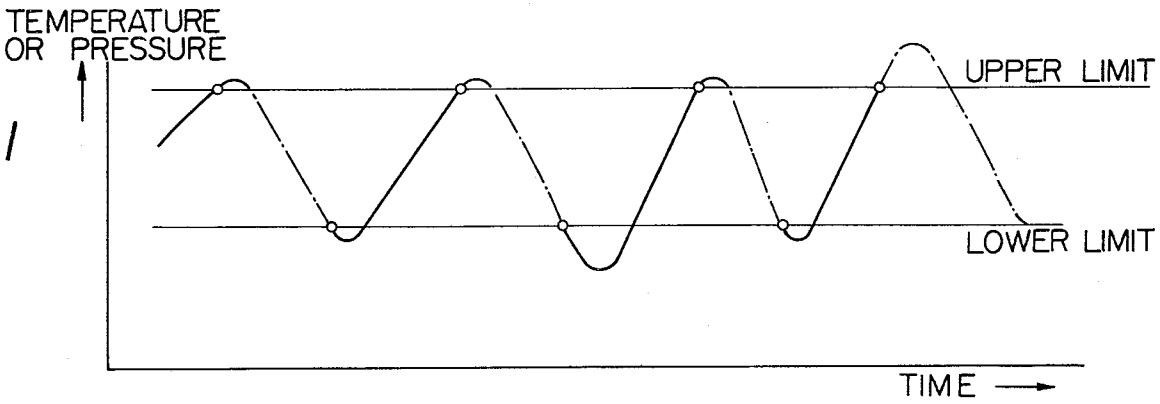
FIG. 1 is a view diagrammatically showing the control characteristics obtained by a prior art vapor temperature/pressure control system.

There are several known ways of controlling the volume of fuel to be supplied to the vapor generating unit for the purpose of vapor temperature/pressure control. One, probably the most practical way is that a suitable upper limit and lower limit of the vapor temperature or pressure are preset as shown in FIG. 1 and the vapor temperature/pressure is controlled and maintained between these two limits. To this end, the actual vapor temperature/pressure is continuously sensed and compared with the both reference limit values. When the actual temperature/pressure exceeds the upper limit, a fuel supply valve of a vapor generating unit is closed to shut off fuel delivery thus lowering the vapor temperature/pressure, while the valve is opened when the actual temperature/pressure drops below the lower limit. The vapor temperature or pressure may be thus desirably controlled within this range, with tolerable overshoot and undershoot beyond this range, as long as the engine load is nearly constant.

As soon as the engine load is greatly changed, however, the vapor temperature/pressure becomes out of control. If, for instance, the vehicle operator depresses an accelerator pedal to fully open the throttle valve, the amount of vapor allowed into the engine is abruptly increased causing a corresponding drop in the temperature/pressure of the vapor. If this occurs during closure of the fuel supply valve, the temperature/pressure drop largely exceeds the tolerable undershoot below the lower limit. If the throttle valve is then suddenly closed for deceleration, the temperature/pressure undesirably rises and will exceed the upper limit while the fuel supply valve is open.

Figure 4:
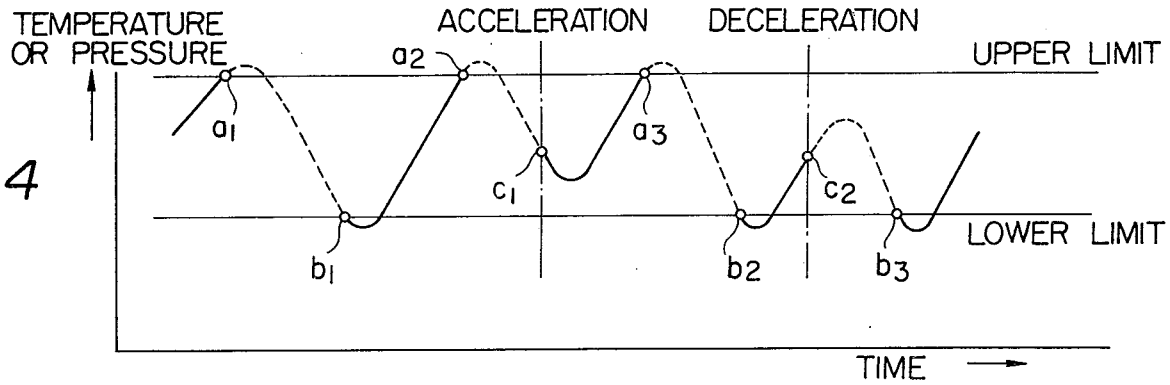
FIG. 4 is a view diagrammatically showing the control characteristics obtained by the system shown in FIGS. 2 and 3.
Figure 2:
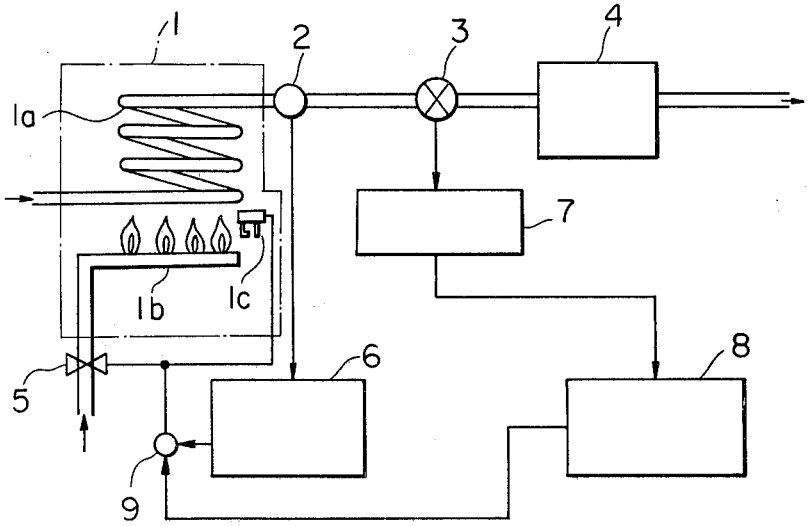
FIG. 2 is a schematic view of a vapor temperature/pressure control system for an automotive vapor-powered engine according to this invention.

The aforementioned drawbacks and inconveniencies are eliminated by a preferred embodiment of this invention that will be described below with reference to FIGS. 2 to 4. As shown, a vapor generating unit 1 is connected with a vapor expansion unit 4 forming part of an engine body (not shown) through an operator manipulable throttle valve 3. The vapor generating unit 1 as usual, includes a burner **1*b* with an ignition plug 1*c* for producing vapor by burning fuel and a heat exchanger 1*a* for heating the vapor produced. The vapor generator is connected with a vapor condenser (not shown) as in most closed-cylce vapor or steam engines. Fuel is delivered to the burner 1*b* through a fuel supply valve 5 controllable according to this invention. On the heat exchanger 1*a* mounted is a temperature/pressure sensor 2 which is electrically connected with the fuel supply valve 5 through fuel control circuitry 6 and 9 that will be fully described later. The actual vapor temperature or pressure sensed by the temperature/pressure sensor 2 is thus compared with the two reference limit values as previously mentioned to provide output signals to the circuit 6** respectively when the actual temperature/pressure exceeds the upper limit or lower limit.

The throttle valve is associated with a throttle movement sensor 7 which in turn is connected with an acceleration/deceleration command circuit 8. The circuit 8 produces, in any suitable manner, output signals indicating acceleration and deceleration in dependence on the sensed angular displacement of the throttle valve. The output signals from the circuit 6 and those from the circuit 8 are both delivered to a circuit 9 which then produces an output signal commanding the fuel supply valve to open or to close. The ignition plug **1*c* is also connected with the fuel supply valve 5 through the circuit 9 for cooperation with the valve 5 so that the ignition plug 1*c*** ignites the burner simultaneously when the fuel valve is opened and vice versa.

Figure 3:
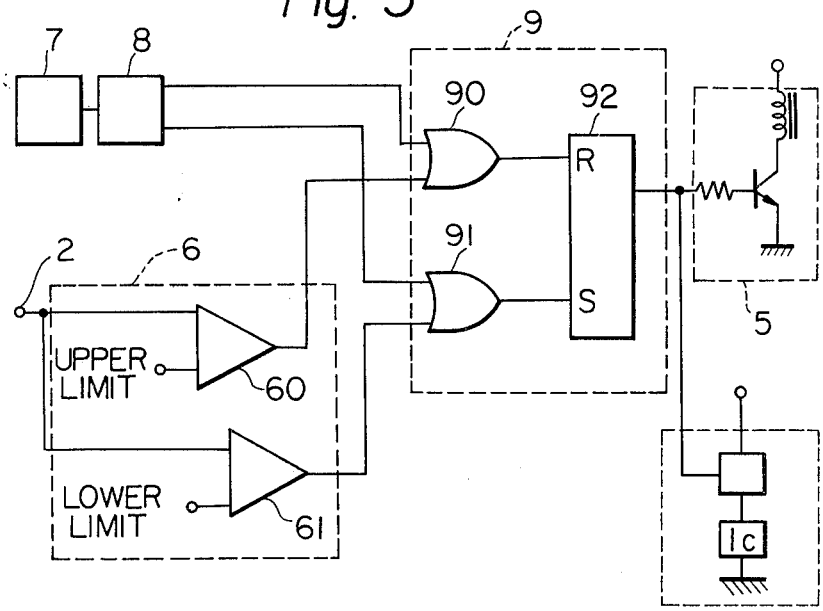
FIG. 3 is a block diagram illustrating the electrical circuit used in the system shown in FIG. 2.

A more detailed circuit construction is illustrated in FIG. 3. The circuit comprises two comparators, one 60 producing an output signal when the sensed actual temperature/pressure applied to one input exceeds the upper limit reference value at the other input, with the other 61 producing an output signal when the temperature/pressure at one input is lower than the lower limit reference value delivered to the other input. The circuit 9 essentially consists of two OR gates 90 and 91 and a bistable multi vibrator or flip flop circuit 92. The gate 90 has a first input for receiving a deceleration signal from the acceleration/deceleration command circuit 8 and a second input for receiving the output from the comparator 60. The gate 91 likewise has a first input for receiving an acceleration signal from the circuit 8 and a second input for receiving the output from the comparator 61. The outputs from the gate 90 and gate 91 are respectively applied to the reset input R and set input S of the flip flop circuit 92. The latter produces a "0" or valve closing signal at its output when "1" signal appears at the input R with no or "0" signal at its input S, while it produces a "1" or valve opening signal when oppositely a "1" signal appears at its set input S.

The operation of the vapor control system in accordance with the aforedescribed embodiment is now explained below in connection with FIG. 4. As long as the throttle valve 3 is maintained in a fixed position, the vapor temperature/pressure is varied substantially as described in connection with FIG. 1: when the comparator 60 produces a signal indicating the vapor temperature/pressure exceeding the upper limit as at $a_1$ in FIG. 4, the OR gate 90 receives this signal and applies an output to the reset input of the flip flop circuit 92. The flip flop circuit then produces an "0" signal since no signal appears at the output of the OR gate 91, causing the fuel supply valve to be closed. At the same time, the ignition plug 1*c* ceases to ignite the burner. The vapor temperature/pressure is then decreased as indicated by a broken line curve in FIG. 4. When the temperature/pressure drop reaches the lower limit $b_1$, the OR gate 91 then delivers the signal "1" to the set input of the flip flop circuit to invert the circuit. Accordingly, the fuel valve is opened and the burner is ignited by plug 1*c*. The temperature/pressure rises as indicated by a solid line curve until it again reaches the upper limit $a_2$, whereat the valve 5 is closed to lower the temperature/pressure. If during this drop in temperature/-pressure the acceleration occurs at the point $c_1$, the acceleration signal from the circuit 8 is delivered to the OR gate 91 so that an output of the OR gate 91 is applied to the set input of the flip flop circuit. Thus, the valve is opened and the burner is ignited substantially at point $c_1$, with the result that the temperature/pressure tends to rise before it reaches the lower limit. As long as the throttle valve is maintained in this position, the fuel supply valve is controlled in the previously described manner to close at $a_3$ and to open at $b_2$. As soon as the throttle valve is abruptly closed at the point $c_2$ with the fuel supply valve being open, the OR gate 90 produces an output upon receiving the deceleration signal from the circuit 8 and delivers it to the reset input of the flip flop circuit 92. The temperature/pressure tends to drop without reaching the upper limit as indicated by a broken line curve in FIG. 4.

It will be readily understood from the above description that the fuel supply valve together with the ignition plug is usually controlled in dependence on the reference temperature/pressure, while being positively opened and closed in quick response to a predetermined variation in the engine load independently of the reference temperatures. Accordingly, the actual temperature or pressure of the vapor to be delivered to the engine is desirably maintained within a suitable limit, providing a stable and safe operation of the engine.

Figure 5:
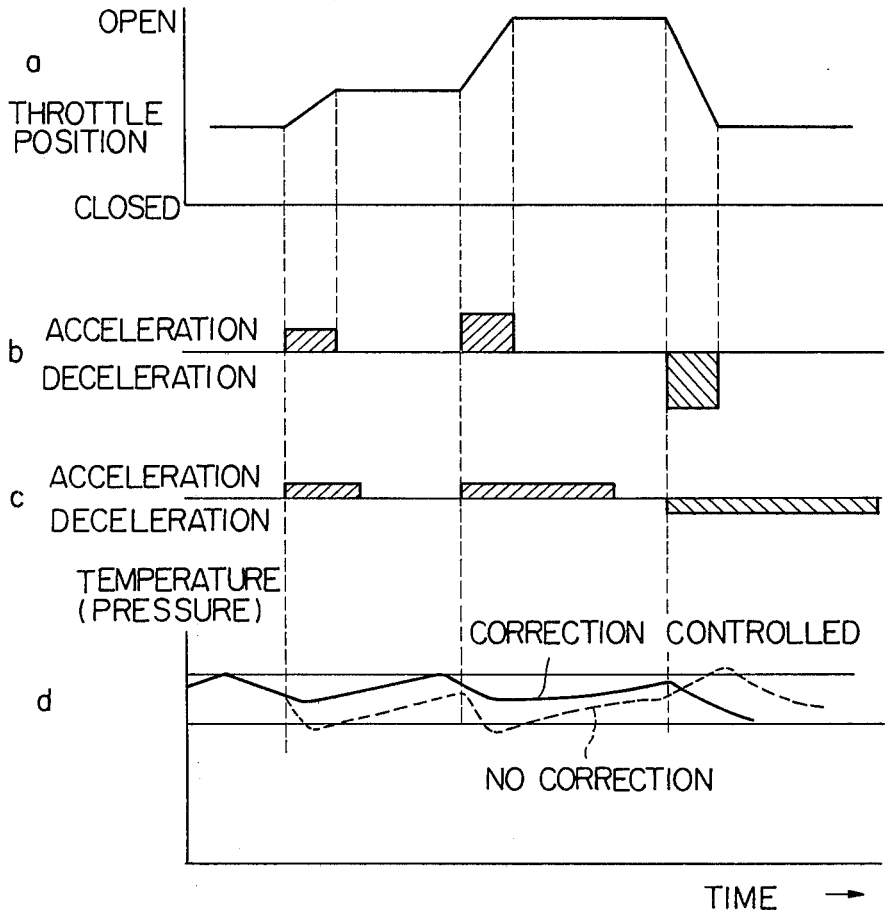
FIG. 5 is a view diagrammatically showing the control characteristics obtained in accordance with the basic principle of this invention.

FIG. 5 illustrates an analog-control of the vapor temperature/pressure basically in accordance with the principle of the present invention. The angular position of the throttle valve is varied as shown in FIG. 5(*a*). An acceleration/deceleration command circuit, corresponding to the circuit 8 in FIG. 2, produces an acceleration signal and a deceleration signal respectively proportional to the positive and negative differential values of the movement of the throttle valve, as shown in FIG. 5(*b*). The fuel supply valve is thus analog-controlled in response to the acceleration and deceleration signals delivered from the acceleration/deceleration command circuit, providing the desired characteristics of the vapor temperature/pressure as indicated by the solid line curve in FIG. 5(*d*). If such corrective control should not take place, the temperature or pressure is undesirably too low or two high during acceleration or deceleration, as will be apparent from the broken line curve in FIG. 5(*d*).

The pulse width in which the throttle valve is moved for acceleration and deceleration, as indicated in FIG. 5(*c*), may be utilized as a control variable, instead of the differential values of the throttle valve movement, if desired.

What is claimed is:

1. In an automotive vapor powered engine with a manually operable throttle valve, the combination comprising a vapor generating unit generating a vapor by burning fuel therein, a fuel supply valve for supplying combustion fuel to said vapor generating unit, means for sensing the temperature of the vapor generated at said vapor generating unit, means for producing a first output signal when the sensed temperature exceeds a predetermined upper value and for producing a second output signal when the sensed temperature drops below a predetermined lower value, means for closing and opening said fuel supply valve in response respectively to said first output signal and said second output signal, means for sensing the angular movement of the throttle valve and producing an acceleration command signal and a deceleration command signal, and correction control means for opening said fuel supply valve in response to the acceleration command signal independently of said second output signal and closing said fuel supply valve in response to the deceleration command signal independently of said first output signal.

2. The combination of claim 1 further comprising an ignition plug for igniting the fuel in said vapor generating unit, said ignition plug being operatively connected with said fuel supply valve to ignite the fuel when said fuel supply valve is open and to cease ignition when the fuel supply valve is closed.

3. The combination of claim 1 in which said means for producing a first and second signals comprises a first comparator having a first input for receiving a signal representative of the actual temperature of the vapor from the temperature sensing means and a second input for receiving a reference signal representative of said predetermined upper value, and a second comparator having a first input for receiving the actual temperature of the vapor from the temperature sensing means and a second input for receiving a reference signal representative of said predetermined lower value.

4. The combination of claim 2 in which said correction control means comprises a first OR gate having a first input for receiving the deceleration command signal from the throttle movement sensing means and a second input for receiving the output signal from the said first comparator, a second OR gate having a first input for receiving an acceleration command signal from the throttle movement sensing means and a second input for receiving an output signal from said second comparator, and a flip flop circuit having a reset input connected with an output of said first OR gate, a set input connected with an output of said second OR gate and an output means operatively connected with the fuel supply valve for producing a signal for opening of said fuel supply valve when a signal appears at the set input with no signal at the reset input and for producing a signal for closing said fuel supply valve when a signal appears at the reset input with no signal at the set input.

5. The combination of claim 1 in which said means for sensing the movement of the throttle valve comprises means for producing a signal proportional to the differential values of the movement of the throttle valve.

6. The combination of claim 1 in which said means for sensing the movement of the throttle valve comprises means for producing a signal proportional to the time period for which the throttle valve is moved.

7. In an automotive vapor powered engine with a manually operable throttle valve, the combination comprising a vapor generating unit generating a vapor by burning fuel therein, a fuel supply valve for supplying combustion fuel to said vapor generating unit, means for sensing the pressure of the vapor generated at said vapor generating unit, means for producing a first output signal when the sensed pressure exceeds a predetermined upper value and for producing a second output signal when the sensed pressure drops below a predetermined lower value, means for closing and opening said fuel supply valve in response respectively to said first output signal and said second output signal, means for sensing the angular movement of the throttle valve and producing an acceleration command signal and a deceleration command signal, and correction control means for opening said fuel supply valve in response to the acceleration command signal independently of said second output signal and closing said fuel supply valve in response to the deceleration command signal independently of said first output signal.

8. The combination of claim 7 further comprising an ignition plug for igniting the fuel in said vapor generating unit, said ignition plug being operatively connected with said fuel supply valve to ignite the fuel when said fuel supply valve is open and to cease ignition when the fuel supply valve is closed.

9. The combination of claim 7 in which said means for producing a first and second signals comprises a first comparator having a first input for receiving a signal representative of the actual pressure of the vapor from the pressure sensing means and a second input for receiving a reference signal representative of said predetermined upper value, and a second comparator having a first input for receiving the actual pressure of the vapor from the pressure sensing means and a second input for receiving a reference signal representative of said predetermined lower value.

10. The combination of claim 8 in which said correction control means comprises a first OR gate having a first input for receiving the deceleration command signal from the throttle movement sensing means and a second input for receiving the output signal from the said first comparator, a second OR gate having a first input for receiving an acceleration command signal from the throttle movement sensing means and a second input for receiving an output signal from said second comparator, and a flip flop circuit having a reset input connected with an output of said first OR gate, a set input connected with an output of said second OR gate and an output means operatively connected with the fuel supply valve for producing a signal for opening of said fuel supply valve when a signal appears at the set input with no signal at the reset input and for producing a signal for closing said fuel supply valve when a signal appears at the reset input with no signal at the set input.

11. The combination of claim 7 in which said means for sensing the movement of the throttle valve comprises means for producing a signal proportional to the differential values of the movement of the throttle valve.

12. The combination of claim 7 in which said means for sensing the movement of the throttle valve comprises means for producing a signal proportional to the time period for which the throttle valve is moved.

* * * * *